United States Patent [19]

Simpson

[11] Patent Number: 4,837,975

[45] Date of Patent: Jun. 13, 1989

[54] EXTERNALLY MOUNTED LATCH FOR SLIDABLE SASH WINDOW

[75] Inventor: Harold Simpson, Hazel Crest, Ill.

[73] Assignee: Ashland Products Company, Chicago, Ill.

[21] Appl. No.: 148,035

[22] Filed: Jan. 25, 1988

[51] Int. Cl.[4] ..... E05D 15/22

[52] U.S. Cl. ..... 49/175; 49/449; 292/175

[58] Field of Search ..... 292/175, 153; 49/161, 49/450, 180, 181, 175, 453, 449, 394, 174, 176

[56] References Cited

U.S. PATENT DOCUMENTS

| | | | |
|---|---|---|---|
| 139,430 | 5/1873 | Smith | 292/153 X |
| 3,095,225 | 6/1963 | Domsic et al. | 49/394 X |
| 3,698,883 | 10/1972 | Di Fazio | 49/449 |
| 4,475,311 | 10/1984 | Gibson | 49/176 |
| 4,553,353 | 11/1985 | Simpson | 49/175 X |
| 4,669,765 | 6/1987 | Ullman | 292/175 X |

FOREIGN PATENT DOCUMENTS

| | | | |
|---|---|---|---|
| 321859 | 11/1929 | United Kingdom | 292/175 |

*Primary Examiner*—James R. Brittain
*Attorney, Agent, or Firm*—Myron C. Cass

[57] ABSTRACT

A pre-assembled latch for mounting externally on the header of a pivotal sash window of a double-hung sash window assembly. The latch includes a housing having a spring-biased latch bolt normally providing a protruding bevelled formation for engaging a guide rail of the window assembly. The housing has means integral therewith for retaining the latch bolt operably assembled in the housing and the latch bolt has means cooperating with the housing for retaining the spring means in biasing association with the latch bolt.

13 Claims, 4 Drawing Sheets

EXTERNALLY MOUNTED LATCH FOR SLIDABLE SASH WINDOW

This invention relates generally to a manually operative latch for a window sash of a double-hung window assembly and more particularly, to a novel latch constructed to be supplied as an assembled operable latch ready for mounting externally on the top header of a window sash.

BACKGROUND OF THE INVENTION

A double-hung window assembly includes a window frame and a pair of window sashes reciprocal vertically in guide rails of the master frame jamb of the window assembly. Such a window sash also can be pivotally mounted in the window frame. Normal vertical movement of the window sash is maintained by latch mechanisms located at opposed corners of the window sash. Such a latch mechanism will include a latch bolt or slider which can slide along the guide rails and which, while engaged in the guide rails, prevents pivoting of the window sash. When the latch bolt is retracted from the guide rail, the window sash can be pivoted on suitably installed pivot pins which usually engage sash balance mechanisms of the assembly.

The window sash can be formed either of extruded plastic frame members or metal frame members joined at corners to form a generally rectangular frame in which the glazing is mounted. In my U.S. Pat. Nos. 4,553,353, 4,578,903 and 4,622,778 are disclosed latch mechanisms in which the latch bolt or slider is located on the interior of the header member of the sash frame and a control button is accessible externally of the header members for operating the latch. In each instance, the latch includes coil springs normally biasing the latch bolt into engagement with the opposing guide rail. It will be seen that these latches cannot be preassembled for shipment to the window manufacturer ready for installation as a complete or assembled unit with the coil spring already in place. Thus, these latches are supplied in knocked-down assembly and hence entail a labor expense factor in their installation attributable to the assembly procedure required for installation.

My U.S. Pat. No. 4,622,778 disclosed a latch for a window sash which is mounted externally on the header member of the window. However, this latch also is not capable of being supplied as an assembled unit ready for installation. The configuration of the individual parts of the latch does not provide for their assembly and shipment as a complete unit ready for installation. Consequently, this latch necessitates labor time involvement for its assembly and installation.

THe latch of U.S. Pat. No. 4,622,778 also includes a "connector member" of L-shaped configuration which has a dual function, one of which is to maintain the latch bolt and coil springs in place for operation. A prior art latch for external mounting on the header member is specifically described and shown herein which does not use such a connector member. In this latch structure, there is no connector member which has a flat part to hold the coil springs and bolt in place for assembly. Consequently, in such a prior latch, the parts are shipped knocked-down and are to be assembled in situ prior to installation of the header member. Here, the coil springs and latch bolt are placed in a cap or cover member and are required to be retained in place manually by the assembler. Then, the unit must be manipulated by inversion for placement flat on the header so that the header surface can function to keep the coil springs and latch bolt in operable assembly in the cover or cap. This manipulative procedure requires speed and dexterity in order to keep the coil springs from dislodging before the latch parts can be secured to the header.

The latch embodying the invention enables the latch to be supplied to the window manufacturer as a completely assembled unit ready for installation on the header member of the window sash.

SUMMARY OF THE INVENTION

A latch for external mounting on the header member of a pivotal window sash which is provided already assembled and ready for installation. The latch is comprised of a housing, a latch bolt or slider and spring means. The latch bolt has means integrally formed therewith constructed and arranged to retain the spring means in place in the housing. Further, the housing has cooperating means for preventing inadvertent separation or disloding of the latch bolt from the housing during sliding movement of the latch bolt.

DESCRIPTION OF THE PREFERRED EMBODIMENT

Figure 1:
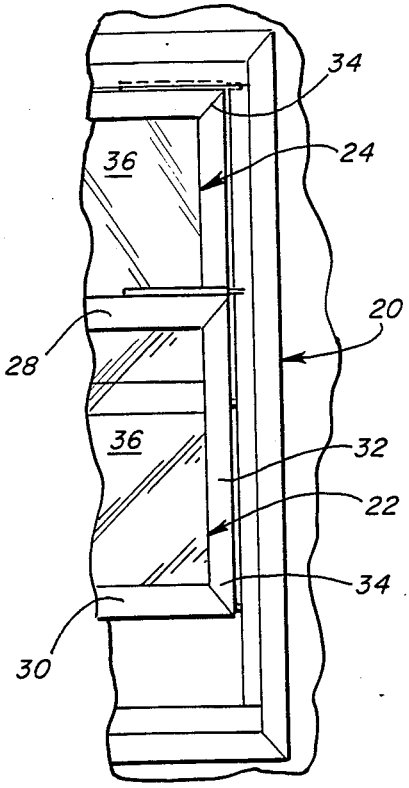
FIG. 1 is a fragmentary front elevational view of a double-hung window assembly having the latch embodying the invention installed on a window sash of the assembly.

FIG. 1 illustrates partially a representative window of the so-called double-hung window assembly. Such an assembly includes a main jamb frame 20 within which is slidably mounted a pair of double hung sashes 22 and 24 fitted with suitable glazing. Both the frame 20 and sashes 22 and 24 can be formed of several different materials, such as metal or strong and rigid plastic materials well known in this field. For purposes of this invention, the sashes 24 and 22 are pivotal relative to the frame 20 to permit cleaning and other other required maintenance thereof.

The main frame 20 and the sashes 22 and 24 preferably are fabricated from elongate framing members of hollow configuration in transverse cross-section for well known reasons of weight economy and thermal insulation advantages. The exact construction of main frame 20 is not critical for achieving the advantages of this invention. The vertical structural members of the frame 20 will mount sash balances (not shown) which will cooperate with pivot pins (not shown) installed on the sashes 22 and 24 to permit desired pivotal movement of the sashes relative to the master frame. Further, these vertical structural members of the frame 20 will present guide rails facing toward a contiguous sash with which the latch mechanis embodying the invention operates. A typical guide rail is designated 26 in FIG. 2 for the purpose of describing this invention. The guide rail 26 would be formed in a side jamb 27 of the jamb frame 20.

Figure 2:
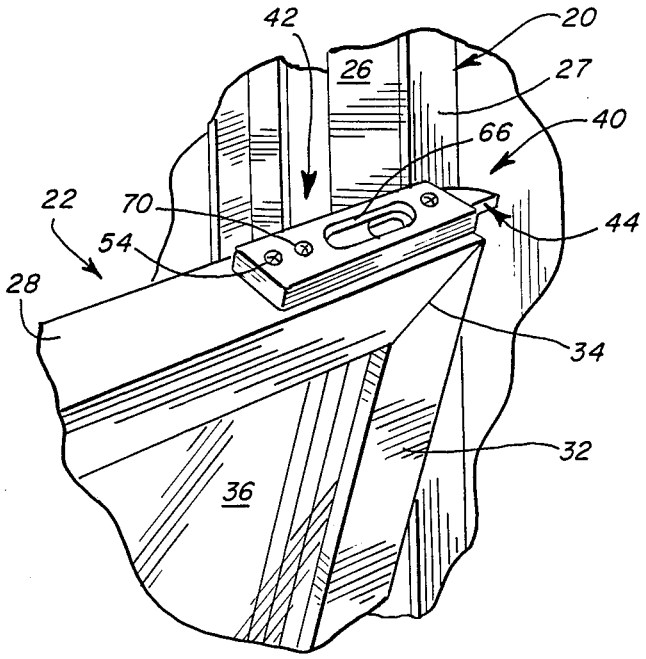
FIG. 2 is a fragmentary perspective view of a window sash in a pivoted open position and displaying the latch embodying the invention installed.

Referring to FIGS. 1 and 2, a sash 22 is generally rectilinear in configuration and is comprised of a top header 28, a base 30 and a pair of side members or stiles, one of which is illustrated at 32. The stiles or side members 32 are jointed at their extremities to contiguous extremities of the header and base members, as seen at 34, to provide the sash frame of desired size and configuration. The jointed corners of the sash are maintained by suitable fasteners and brackets of well-known commercially available types. It will be appreciated that the upper sash 24 will be of like or similar construction. The glazing 36 is conventionally installed in a sash frame.

Figure 13:
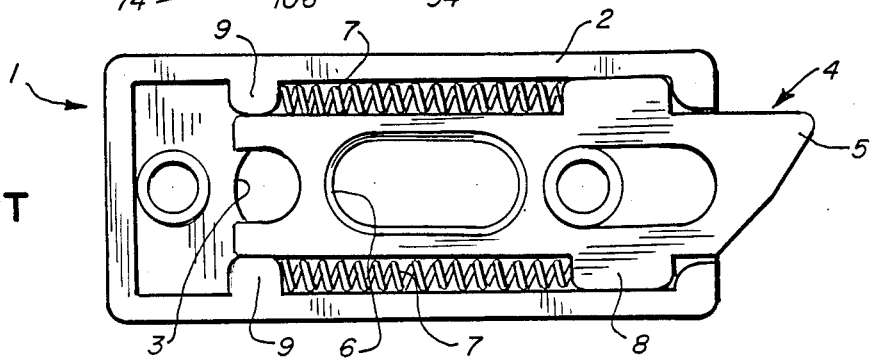
FIG. 13 PRIOR ART
FIG. 13 is a bottom plan view of a prior art latch assembled preparatory to installation on the header member.

Referring to FIG. 13, a prior art latch is illustrated and designated by the referance numeral 1. The latch 1 is provided with a housing 2, an access opening 3, a bolt 4 having a beveled latch formation at one end 5 and an ovate finger pull opening 6, as well as a pair of springs 7 secured between rectangular bolt wings 8 and spring stop members 9. During normal installation practice, the housing 2 is placed on its back as shown in FIG. 13 and the bolt 4 and springs 7 are operationally positioned therein. To install the header 28 of a window sash 22, it will be necessary to manually hold the springs in place and rapidly invert the latch for placement flat on the sash header 28. Care must be taken so that the springs 7 and the latch bolt 4 do not dislodge from the housing. This a labor-intensive operation and time is lost in production where these parts are dislodged.

The latch embodying the invention is designated generally by the reference character 40 in FIG. 2. The component parts of the latch 40, as seen in exploded view of FIG. 4 include a cover or housing 42, a latch bolt 44 and a coil spring 46. The housing 42 and the latch bolt 44 are plastic molded members of suitably strong synthetic resin, such as polystyrene, for instance. The latch 40 is seen installed externally on the header 28 of the sash 22 in FIG. 2 and exposed for manual operation thereof.

Figure 4:
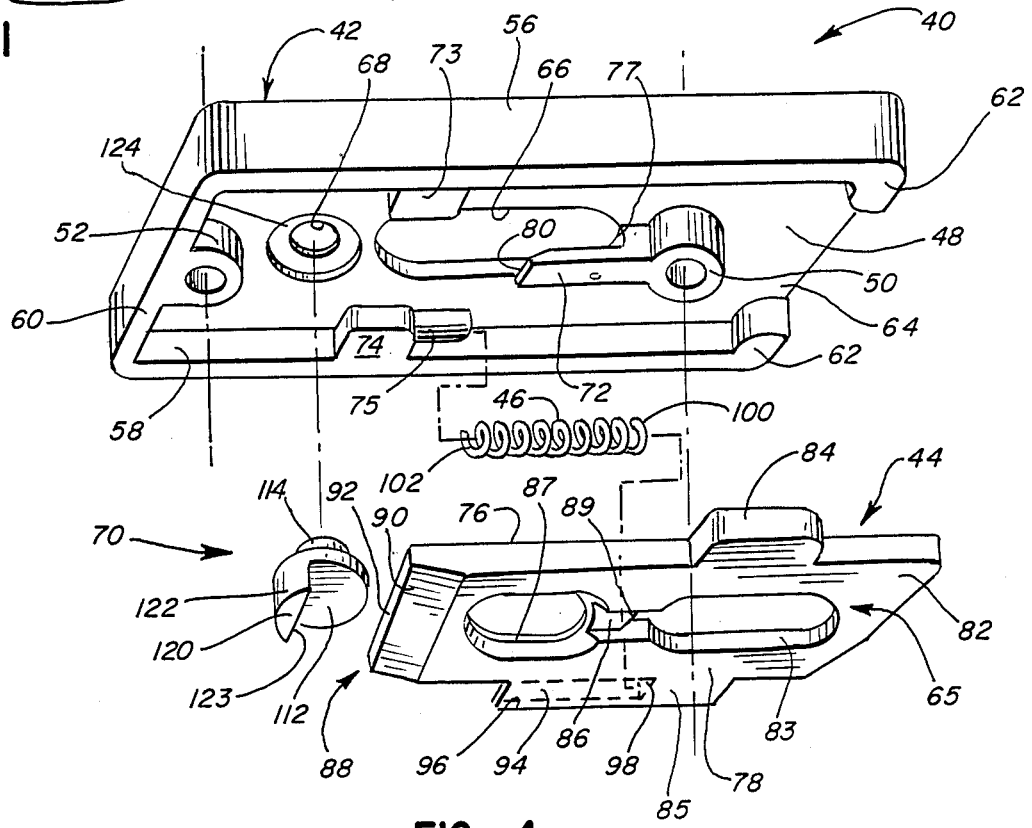
FIG. 4 is an exploded perspective view of the latch embodying the invention which is illustrated in FIG. 2.
Figure 3:
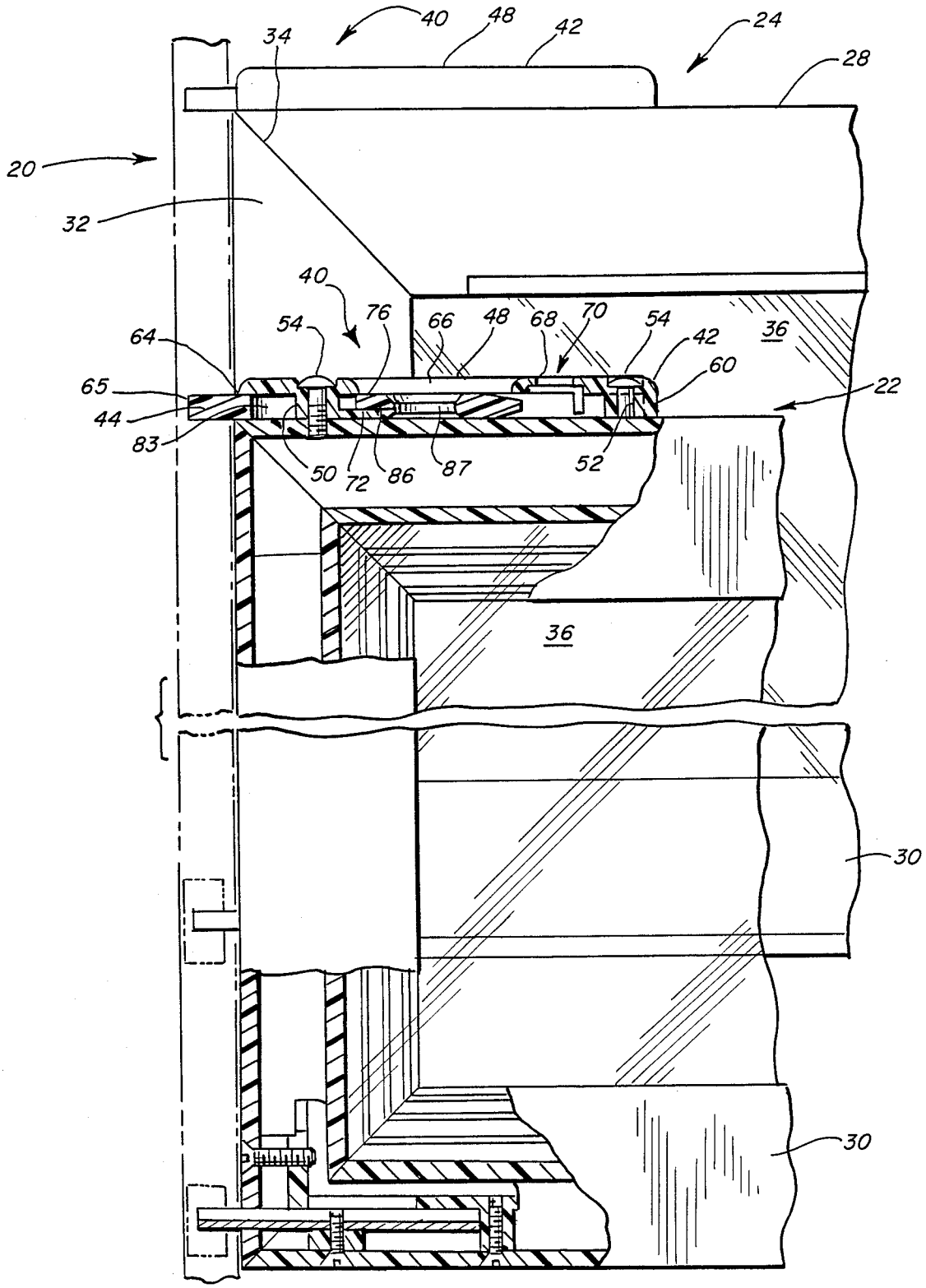
FIG. 3 is a vertical sectional view taken through the length of the latch as shown installed in FIG. 2.

Referring to FIGS. 3 and 4, the housing or cover 42 is rectangular in configuration and has a planar top wall 48 having a pair of depending, spaced apart posts 50 and 52 integral therewith. The posts 50 and 52 each have openings therethrough for accommodating a self-threading fastener 54 for fastening the latch 40 to a header 28. Depending from top wall 48 are depending side wall flanges 56 and 58 connected by a depending end wall flange 60. Each flange 56 and 58 has a right angle wall segment 62 at its free end, the segments 62 facing toward and spaced from one another to define a passageway 64 for passage of the engagement end 65 of the latch bolt 44. The post 52 is seen joined to the end wall 60. The post 50 is in closer proximity to the passageway 64 and opposing same on a line centered between segments 62.

Top wall 48 has an elongated oval or cartouche-like access opening 66 therein located somewhat medially in said wall 48. The circular opening 68 in top wall 48 serves to accommodate the rotatable lock element 70 which will be described in greater detail.

The post 50 has a latch bolt retainer member 72 integral therewith and extending partially across the opening 66 in a direction toward the end wall flange 60. Extending at right angles from the side wall flanges 56 and 58 and toward one another are the spaced apart short wall segments 73 and 74. The segments 73 and 74 are located between the posts 50 and 52 and do not intercept or reach into the opening 66. Integral with the segment 74 is a spring stop member 75 which extends in a direction toward the end wall 62 of side flange 58 and terminates far short of the end wall 62.

As seen in FIG. 4, the short metal coil spring is designated 46. The selected length for the spring 46 will be amplified.

The latch bolt 44 is an integral, planar member with particular formations provided from end-to-end thereof for achieving specific functions. The entire upper surface 76 of the latch bolt 44 is planar, smooth and uninterrupted except for certain through-slot openings from the surface 76. The latch bolt 44 also has a substantially planar lower surface 78.

Latch bolt 44 has a beveled end or latch formation 82, through which extends on ovate slot 83. Extending outwardly from opposite sides of the latch bolt are the wings 84 and 85 and located between the extremities of ovate slot 83. Extending inwardly from slot 83 is an undercut segment 86 which opens to a second ovate actuator slot 87. The opposite end of the latch bolt 44 is designated 88 which is slightly tapered in its surface 90 opposite the top wall 80 and toward the extremity 92 which is less thick than the remainder of the latch bolt 44.

Figure 5:
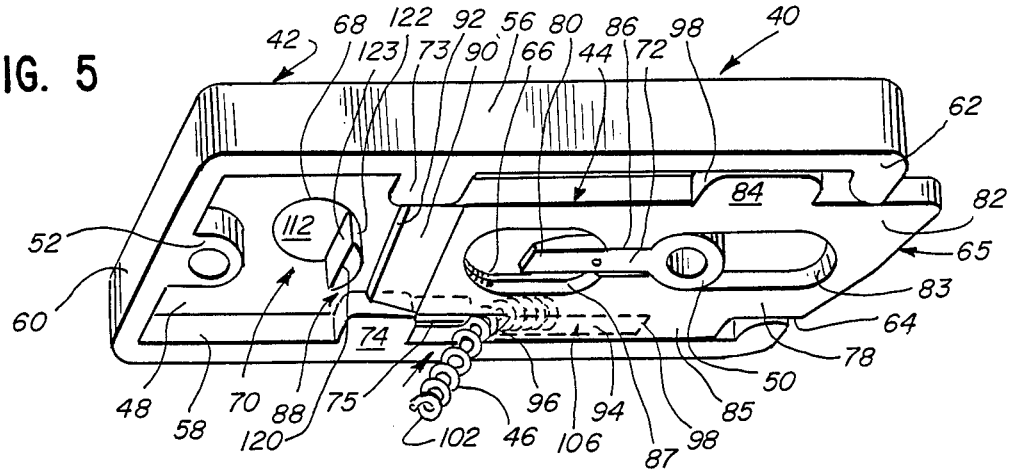
FIG. 5 is a bottom perspective view of the assembled latch illustrated in FIG. 4, but showing the coil spring being installed therein.

Referring to FIGS. 4 and 5, the latch bolt 44 is designed to be positioned within the cover 42 so that the latch formation 82 projects through the passageway 64, the post 50 is located within the slot 83, and the latch bolt retainer member 72 slidably engages the undercut segment 86. The bolt 44 is adapted to be snap-fit into the cover 42 for reciprocal linear sliding movement therein.

The latch bolt 44 has a laterally extending lip formation 94 which is flush with the lower surface 78 and extends from the wing 85 toward the extremity 92 and terminates far short thereof at an end 96. The axial length of the lip 94 is selected to be substantially less than the linear distance between wall segment 62 and wall segment 74. The lip 94 also is less thick than the latch bolt so as to provide a retainer overhang formation for the spring 46 as will be described.

Figure 6:
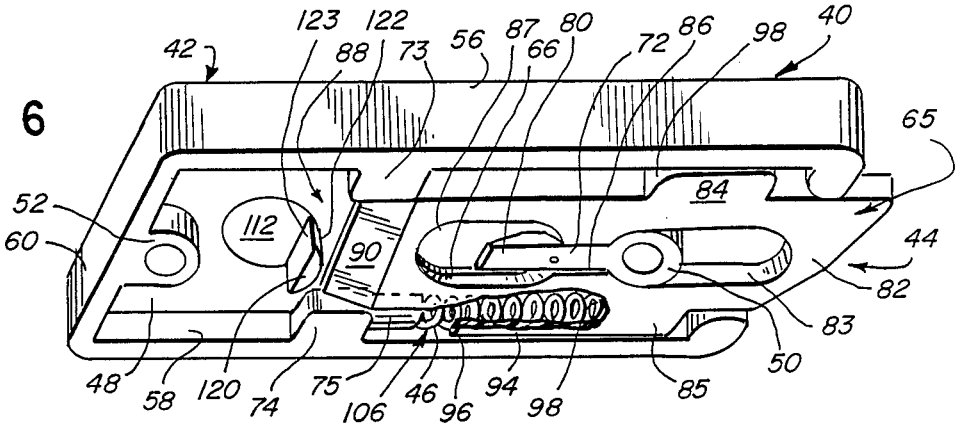
FIG. 6 is a bottom perspective view of the latch illustrated in FIG. 5 with portions broken away to show the spring installed.
Figure 10:
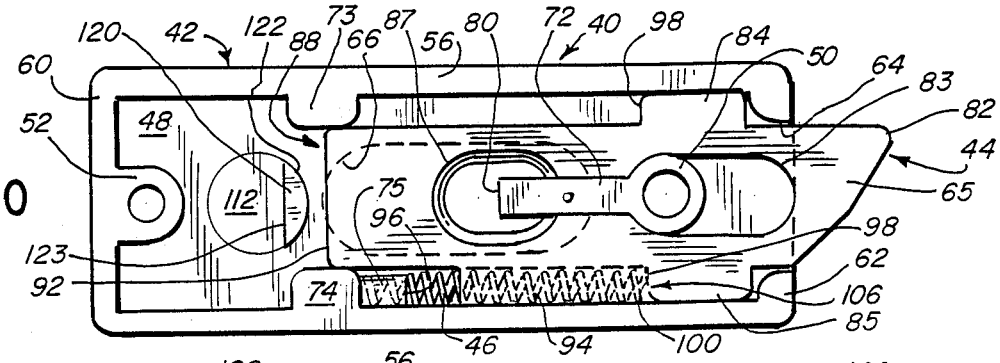
FIG. 10 is a bottom plan view of the assembled latch illustrated in FIG. 9 and shown locked against sliding movement.

The wings 84, 85 each have an end face 98, which on the wing 85 functions as a stop for the end 100 of the spring 46. The end 102 of the spring 46 opposite the end 100 is placed against the spring stop member 75. In FIGS. 4 and 6, the member 75 is shown joined to the flange 58, however the member 75 may be located alternatively in slightly spaced relationship from the inner face of the flange 58 to allow mating engagement with the end 102 of the spring 46 as shown in FIG. 10. The spring 46 is sufficiently long so that when the bolt 44 is installed beneath the cover 42, the spring 46 exerts a biasing force which maintains the bolt 44 projecting through the passageway 64.

Once installed within the cover 42, the spring 46 is located in a pocket 106 defined by the underside of the cover 42, a side edge of the bolt 44, the end face 98, the spring stop 75 and the inside face of the depending side flange 58. The lip 94 is designed to prevent the escape of the spring 46 from the pocket 106 prior to the installation of the latch 30 upon the surface 28 of the sash 22, 24.

Figure 9:
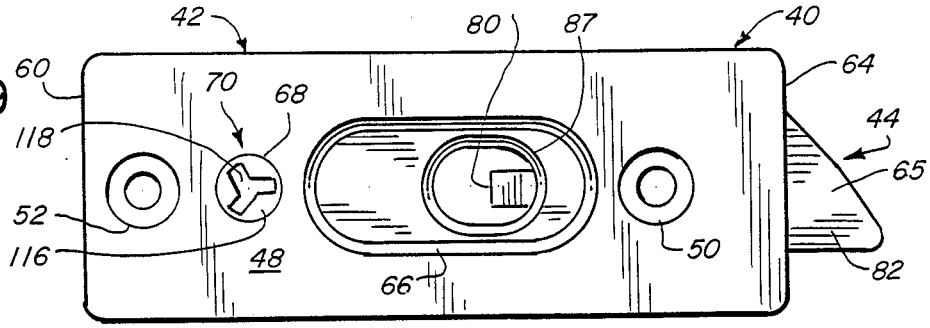
FIG. 9 is a top plan view of the assembled latch illustrated in FIG. 4.

The truncated end 88 of the bolt 44 is designed to engage the lock 70. The lock 70 includes a circular base 112 upon which is fixed an actuator boss 114. A top 116 of the actuator boss 114 is provided with a suitable recess 118 (seen best in FIG. 9) adapted to receive the operational end of a tool, such as the straight edge of a screwdriver. The base 112 has a depending flange 120 which can engage the truncated end 88 along an opposing arcuate side 122 when the bolt 44 is retracted against the normal bias of the spring 46. In FIG. 4, the lock 70 is shown in the retracted or release condition where the planar face 123 of the flange 120 engages the truncated end 88 of the bolt 44 and the beveled end 65 of the bolt 44 is retractable through the passageeay 64 to release the latch 40 from engagement with the frame 20. The boss 116 is friction fitted into the lock aperture 68 for axial rotation therein. The base 112 engages an annular recess 124 in the underside of the cover 42.

Referring to FIG. 5, the latch 40 is shown with the bolt 44 retained within the cover 42 by the retaining member 72 and the lock 70 is in the locked position, wherein inadvertent retraction of the bolt 44 is prevented. The spring 46 is shown being inserted into the pocket 106 over the end 96 of the lip 94. In FIGS. 6 and 10, the spring 46 is shown in the operational position within the pocket 106 and retained therein by the lip 94, and wherein the bolt 44 is biased in the extended condition and is locked against movement to the retracted condition by the lock 70.

Figure 7:
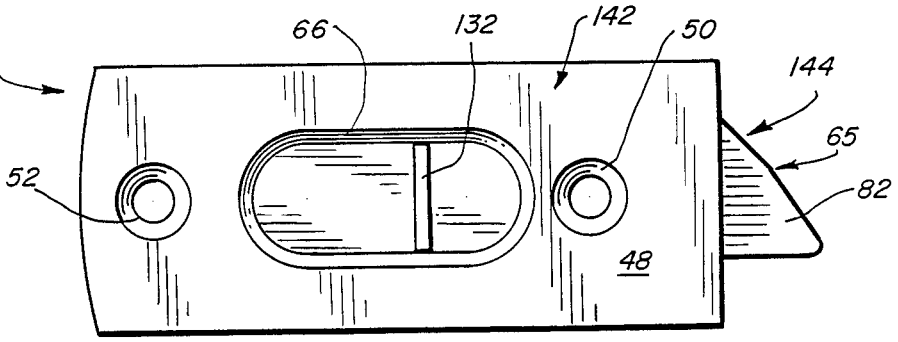
FIG. 7 is a top plan view of a modified embodiment of the assembled latch embodying the invention.
Figure 8:
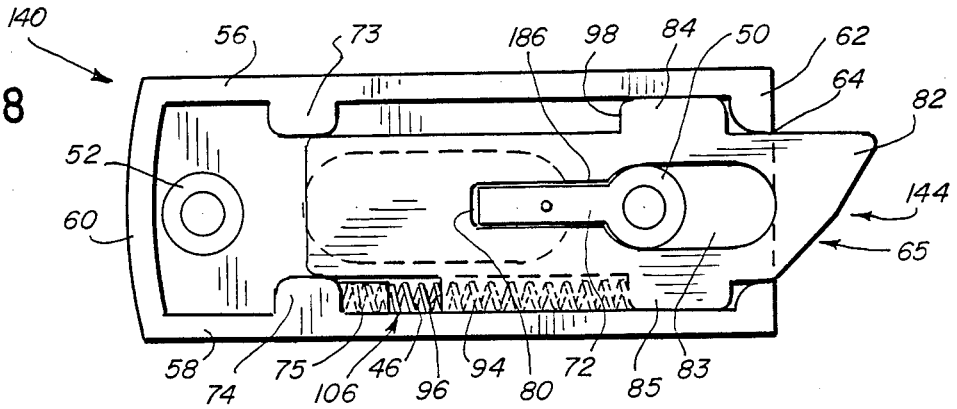
FIG. 8 is a bottom plan view of the assembled latch illustrated in FIG. 7.

An alternate embodiment of the latch 40 is shown in FIGS. 7 and 8 and designated generally by the reference character 140. The latch 140 shares several structural features with the latch 40 and these have been indicated with corresponding reference numerals. The latch 140 differs from the latch 40 in that the lock 70 is absent therefrom, as evidenced by the altered cover 142, and the ovate slot 87 on the bolt 44 described previously has been replaced with a finger flange 132 projecting vertically from the bolt 144 for manual manipulation thereof. Equivalent alternate actuator configurations are contemplated. In addition, the undercut segment 186 is an elongated version of the segment 86.

Figure 11:
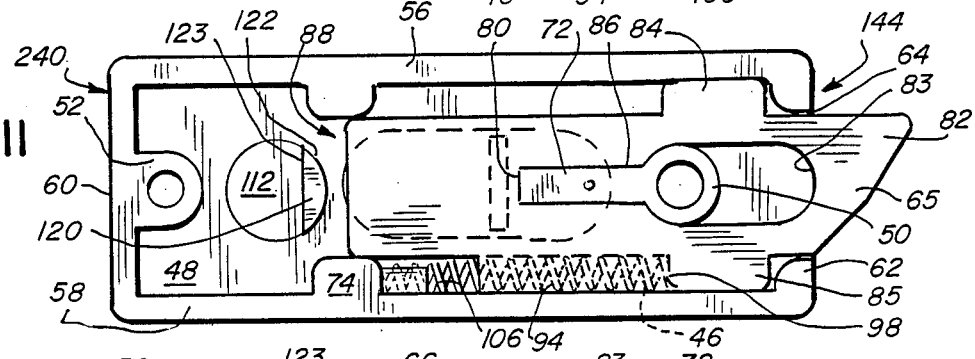
FIG. 11 is a bottom plan view of the latch illustrated in FIG. 7 with the latch bolt slightly modified and locked against sliding movement.
Figure 12:
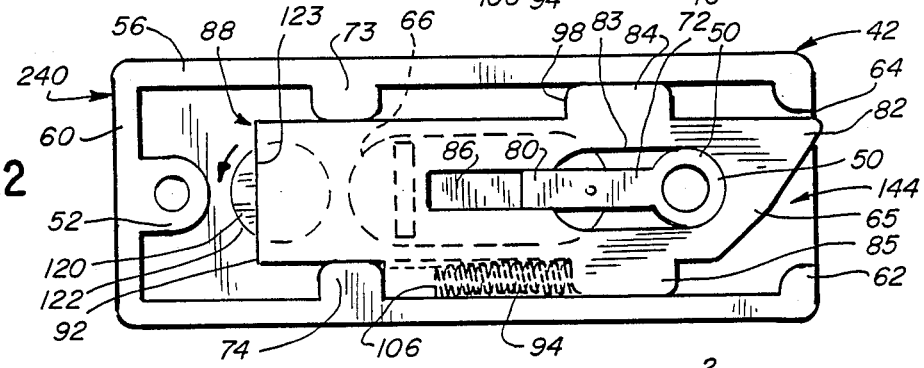
FIG. 12 is a bottom plan similar to FIG. 11 and showing the bolt unlocked for sliding movement.

Referring to FIGS. 11 and 12, a further alternative embodiment of the latch 40 is illustrated, and designated generally by the reference character 240. The latch 240 is distinguishable from the latch 140 in that a lock 70 is provided thereto. The lock 70 is shown in the locked condition in FIG. 11 and in the release or retracted condition in FIG. 12, having been rotated axially in the direction indicated by the arrow 232 to permit the end 65 of the bolt 144 to be retracted within the passageway 64 to release the sash 22,24 for pivoting action within the frame 20.

In addition, FIGS. 11 and 12 illustrate an important feature of the bolt retaining member 72. In FIG. 11, which depicts the locked or extended condition of the latch 240, the retaining member 72 is completely inserted within the undercut segment 186. In this position, the bolt 144 is securely retained within the cover 42. It should be noted here that although the bolt 144 shown in FIG. 11, as well as the bolt 44 in FIG. 10 are shown with the wings 84, 85 abutting the interior face of the wall segments 62 adjacent the passageway 64 to terminate the linear movement of the bolts 40, 140 this is ont the only means of terminating that movement. In fact, it has been found that the movement of the bolts 40, 140 in the extended condition may be terminated by the end 89 of the undercut segments 86,186 contacting the base 77 of the retaining member 72 (seen in FIG. 4). Referring to FIG. 12, the latch 240 is shown in the release or retracted condition, with the truncated end 88 of the bolt 144 engaging the planar side 123 of the lock base flange 120, and the beveled end formation 82 is retracted within the passageway 64. It is evident that in this position, the beveled free end 80 of the retaining member 72 is still engaged in the undercut segment 186 to retain the bolt 144 within the cover 42.

Although not specifically shown, the retaining means can be one or more depnding members from the top wall, such as, a pair of clip members which engage edges of the latch bolt.

While preferred embodiments of the invention have been disclosed, it will be understood that the invention may be otherwise embodied within the scope of the appended claims. Minor variations in the structure and in the arrangement and size of the various parts may occur to those skilled in the art without departing from the spirit and scope of the claims appended hereto.

I claim:

1. In a pivotal window sash adapted for installation in a master frame of a double-hung sash window assembly having opposed, vertically extending guide rails to enable vertical reciprocal sliding movement of the sash in the master frame while cooperatively engaged with the guiderails, the sash having a header, a base and a pair of stiles cooperatively connected together at adjacent extremities thereof to form a rectangular sash frame; a manually operable latch adapted to be installed as a preassembled unit on an exterior surface of the header for releasably securing said sash to said master frame to permit pivotal movement of said sash and comprising:

a housing including a top wall having an access opening therethrough, a pair of opposing end walls, one of said end walls having a passageway therethrough;

a latch bolt slidably received in said housing and having a beveled end aligned with and reciprocal in said passageway and arranged to be engaged in a guide rail for locking the window sash against pivotal movement;

said latch bolt having an opening therethrough with a peripheral edge therearound;

spring means in said housing and engaging said latch bolt normally to bias said beveled end into said guide rail;

said top wall having means integral therewith and depending therefrom for engaging and retaining the latch bolt in operable assembly in the housing and permitting reciprocal sliding movement thereof said engaging means including a post which extends through said bolt opening and a retainer member extending laterally therefrom and extending over said opening peripheral edge at least in said normally biased position to retain said bolt in said housing; and said latch bolt having means integral therewith for engaging said spring means and retaining said spring means in operable assembly in the housing.

2. The latch of claim 1 wherein said spring retaining means comprises a laterally extending lip formation overlying the spring means.

3. The latch of claim 2 wherein said lip formation is spaced from the top wall to define a pocket for said spring means, said pocket having an opening thereinto at one end thereof through which the spring means can be installed in the pocket.

4. The latch of claim 1 wherein said latch bolt is provided with at least one laterally projecting wing formation, said wing formation arranged to engage an inner surface of said housing so as to maintain the alignment of said bolt within said housing.

5. The latch of claim 1 wherein said retainer member comprises an elongate member parallel with and spaced from the plane of said top wall, said latch bolt having an undercut segment intermediate its ends and having said elongate member engaged with said segment.

6. The latch of claim 1 and including locking means for releasably securing said latch bolt in said biased condition.

7. The latch of claim 6 wherein said locking means is actuable from the exterior of said top wall.

8. The latch of claim 7 wherein said locking means is a member mounted on said top wall to depend from the underside thereof for axial rotation thereon and adapted to engage an end of said bolt opposite said beveled end to prevent movement thereof in a direction opposite to said bias for retracting said beveled end from the guide rail.

9. The latch of claim 1 wherein said latch bolt is provided with an additional opening therein which is accessible through said access opening in the top wall.

10. The latch of claim 9 wherein said access opening in the top wall and said additional latch bolt opening each can accommodate a finger therein.

11. The latch of claim 1 wherein said latch bolt includes an upstanding actuator member for manually moving the latch bolt.

12. The latch of claim 1 wherein said housing has means for installing the pre-assembled unit on said header surface comprising a second post depending from the underside of said top wall having a bore therethrough for accepting a fastener capable of retaining the unit secured on the header.

13. The latch of claim 1 wherein said retainer member comprises an elongate member which is supported by said post.

* * * * *